US005309687A

United States Patent [19]

Walston

[11] Patent Number: 5,309,687

[45] Date of Patent: May 10, 1994

[54] STAIRCASE PREFORM WITH WOOD TRIM

[76] Inventor: Richard Walston, 131 Nut Plains Rd., Guilford, Conn. 06437

[21] Appl. No.: 936,039

[22] Filed: Aug. 26, 1992

[51] Int. Cl.[5] ..... E04F 11/10

[52] U.S. Cl. ..... 52/187; 182/82

[58] Field of Search ..... 52/187, 182, 184, 188, 52/190; 182/82; 403/262

[56] References Cited

U.S. PATENT DOCUMENTS

| | | | |
|---|---|---|---|
| 2,939,309 | 6/1960 | Sitton | 52/189 |
| 3,848,378 | 11/1974 | Witte | 52/184 |
| 4,367,613 | 1/1983 | Strub | 52/188 |
| 4,367,864 | 1/1983 | Eldeen | 403/262 |
| 5,058,339 | 10/1991 | Krstovic | 52/187 |

FOREIGN PATENT DOCUMENTS

| | | | |
|---|---|---|---|
| 259042 | 1/1913 | Fed. Rep. of Germany | 52/184 |
| 764284 | 3/1934 | France | 52/182 |
| 507749 | 1/1955 | Italy | 52/190 |
| 1438 | 5/1887 | Sweden | 52/182 |
| 567212 | 2/1945 | United Kingdom | 52/182 |

*Primary Examiner*—James L. Ridgill, Jr.
*Attorney, Agent, or Firm*—Bachman & LaPointe

[57] ABSTRACT

A curved stairway preform designed to be finished in trim thereby simulating a completely wooden curved stairway.

11 Claims, 8 Drawing Sheets

STAIRCASE PREFORM WITH WOOD TRIM

FIELD OF THE INVENTION

This invention relates to curved or spiral stairways or staircases of the type used in sweeping grandiose fashion in domiciles, museums, public buildings and the like in contrast to the central pole "firehouse" variety of stairway. The invention also relates to a conventional straight staircase.

BACKGROUND OF THE INVENTION

In contrast to the usual and customary central pole firehouse stairway and the expensive, expansive, labor intensive, all wooden circular or curved stairway fabricated in minute detail, manually, with myriad wooden piece parts, the present invention relates to the creation and structure of a straight or curved stairway which simulates faithfully the classic wooden stairway.

The process and structure of the present invention provides a curved stairway which simulates, faithfully, the classic wooden stairway while providing an affordable unit which is available to the mass market.

That is, the present invention provides, at a reasonable price, a curved or a straight stairway or staircase having all the aesthetic appearances including greater strength as well as other desirable attributes not found in the classic wooden structure.

It is well known that the classic wooden structure requires meticulous preparation of jigs and fixtures for the assembly by hand, of many, many piece parts including subsequent installation. In fact, the wooden structures require, frequently, dismantling after assembly at the point of manufacture for reassembly at the point of use. Obviously, the labor and expertise involved in the above procedure make the availability of circular stairways available only to a select few who can afford the luxury.

SUMMARY OF THE INVENTION

In contrast the present invention provides a curved or straight stairway which is of a cost level to be within the means of those individuals included in the mass home buying market.

Further the present invention provides a curved stairway which is a faithful reproduction of the classic, expensive all wooden circular stairway.

A further feature of the present invention is the provision of a preform of a curved stairway which is free from deterioration by natural elements because of exposure to weather pending installation.

A further feature of the invention is the provision of a curved stairway preform which serves as an access stairway during the course of construction of a home.

A still further feature of the invention is the provision of a curved stairway preform which is designed to be "trimmed out", along with the usual and customary interior home trimming, with piece parts which simulate faithfully the classic all wooden circular stairway.

It is to be noted that the preform is useful during the course of home construction (without final trim) as an access stairway by construction workers.

It is to be noted further that the preform is weather proof. That is, the preform need not be sheltered prior to use but can be stored exposed to weather at the construction site until time for installation.

A further feature of the invention is the provision of a complete fiberglass reinforced preform of a curved stairway to which wooden or other trim features are attached.

A further feature of the present invention is the provision of a curved stairway preform which is of greater strength than the classic wooden stairway.

A further feature of the invention is the provision of a curved stairway of the above class which is freestanding i.e. no side panels or a stairway having at least one upper sidewall panel and at least one lower sidewall panel.

A further feature of the invention is the provision of a freestanding (no side walls) circular stairway, utilizing the aforesaid preform, in which the underside of the stairway is enclosed by panelling, drywall or plaster, as desired.

A still further feature of the invention is the provision of a complete curved stairway preform fabricated on one segment or in a plurality of segments where the material of fabrication is plastic, fiberglass reinforced plastic, lightweight metal such as aluminum, magnesium, or laminations of such metals and plastic and fiberglass.

A further feature of the invention is the casting or "laying up" of the preform so that at least treads, risers and stringers are secured together in seamless fashion.

A further feature of one embodiment of the invention is the provision of a complete fiberglass reinforced plastic curved stairway preform including treads, risers, and stringers, which can be combined with wooden treads, wooden balusters, wooden handrails and upper and lower wooden newel posts to create a faithful representation of the classic all wooden spiral staircase.

A still further feature of the present invention is the provision of a low-cost curved stairway preform which can be manufactured using mass production procedures in several standard dimensional configurations thereby providing a preform suitable for the main body of low to medium priced housing which upon trimming, simulates faithfully, a much more expensive stairway.

A further feature of the invention is a series of novel process steps for securing a baluster to a handrail and to a second tread means.

Other features and advantages of the present invention will become more apparent from an examination of the succeeding specification when read in conjunction with the appended drawings in which:

DESCRIPTION OF THE INVENTION

Figure 1:
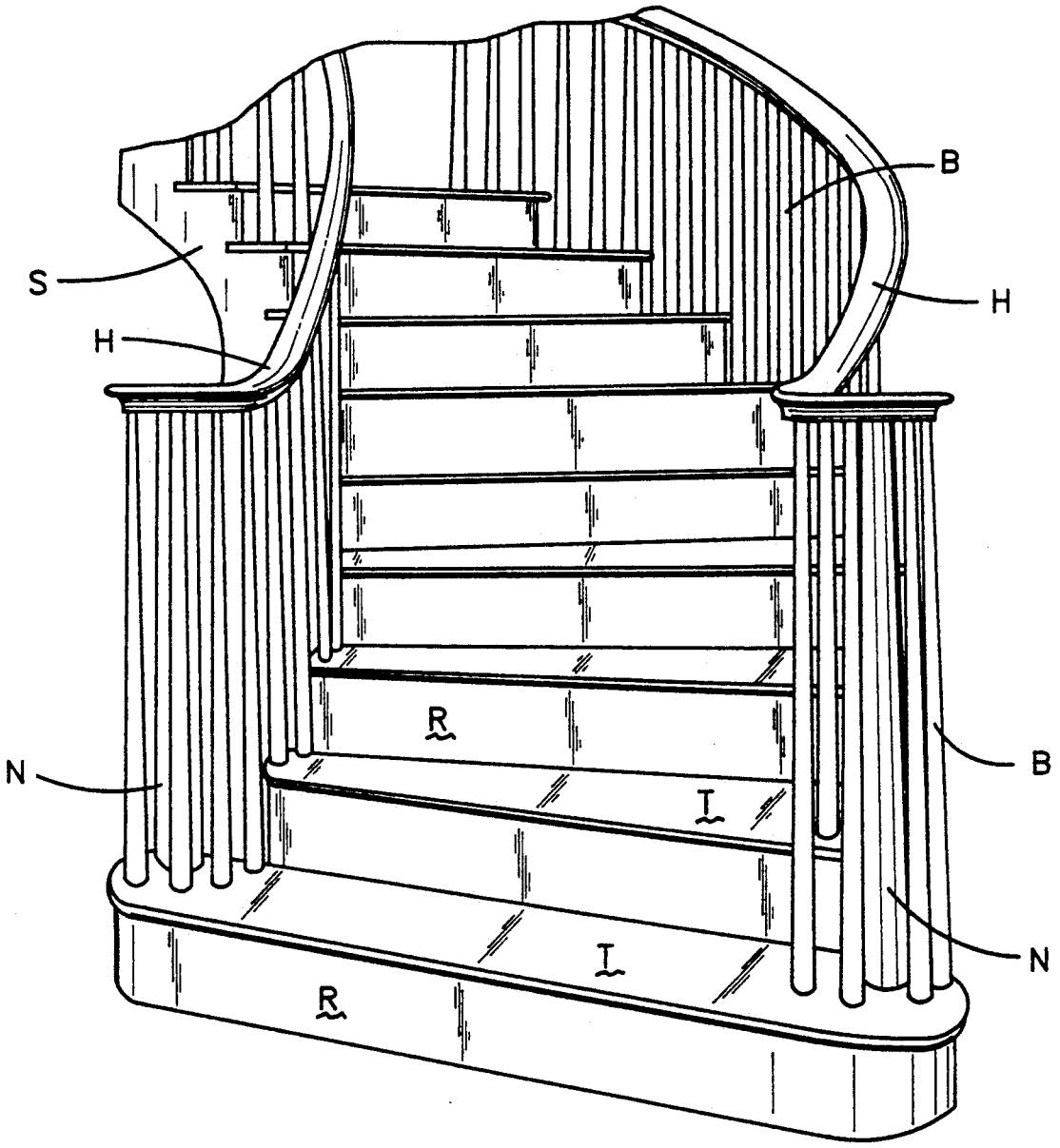
FIG-1 (PRIOR ART)
FIG. 1 is an illustration of the classic prior art curved staircase fabricated entirely of wooden piece parts.

FIG. 1 shows a typical prior art curved stairway fabricated entirely of wooden piece parts with appropriate fasteners and glue, comprising risers R, treads T, balusters B, newel posts N, handrail H and stringers S.

Figure 2:
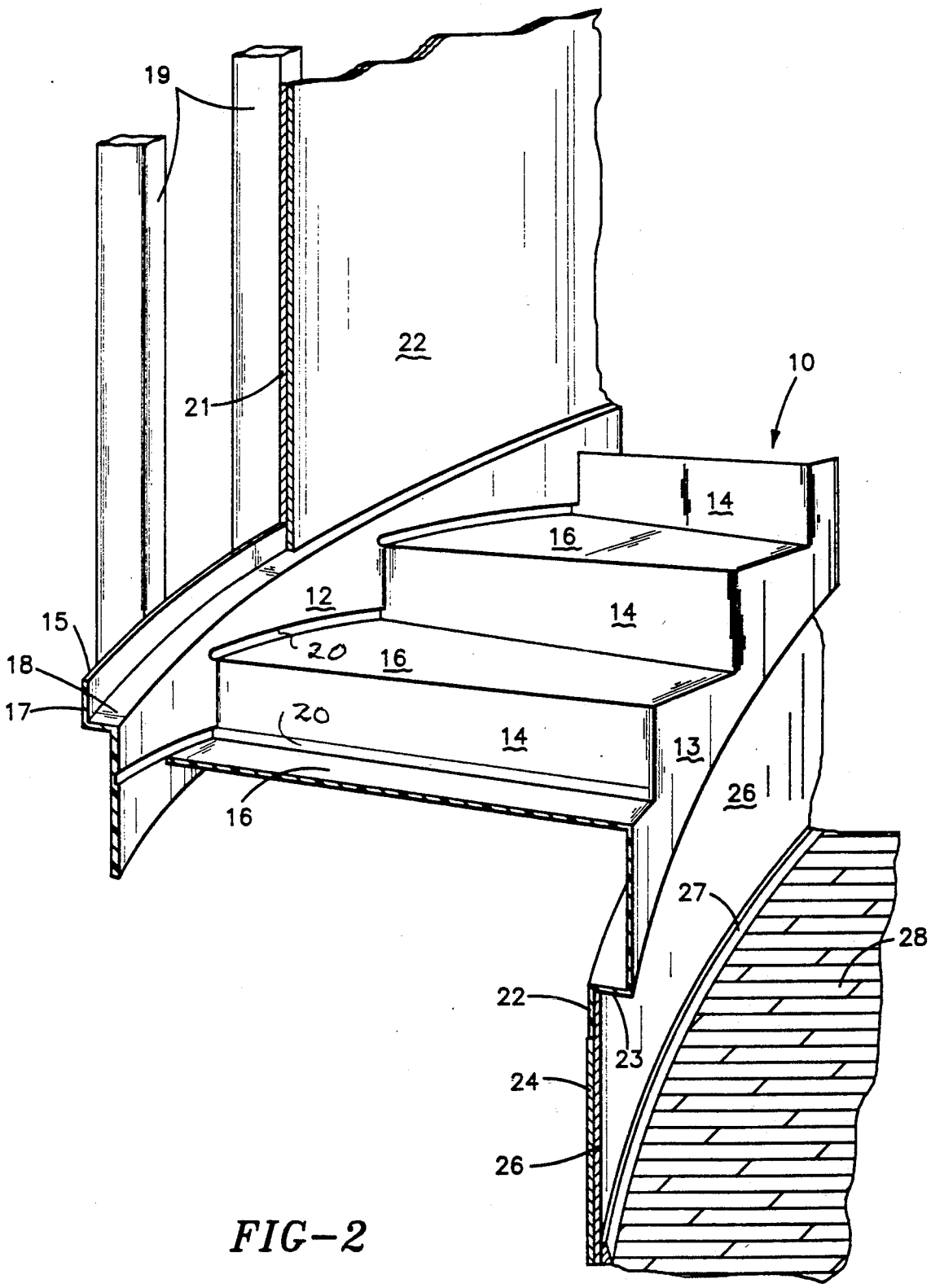
FIG. 2 is a perspective view of a preform of the present invention with top and bottom portions broken away.
Figure 3A:
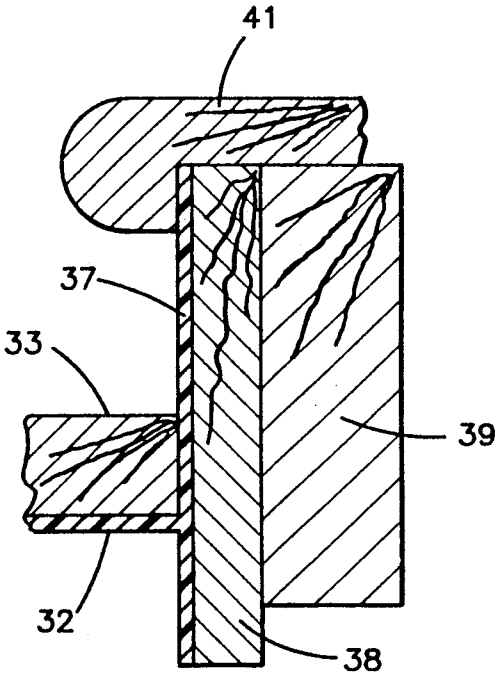
FIG. 3A is a vertical section, enlarged, of the top portion of the preform of FIG. 3 in the plane represented by the line 3A—3A.
Figure 3:
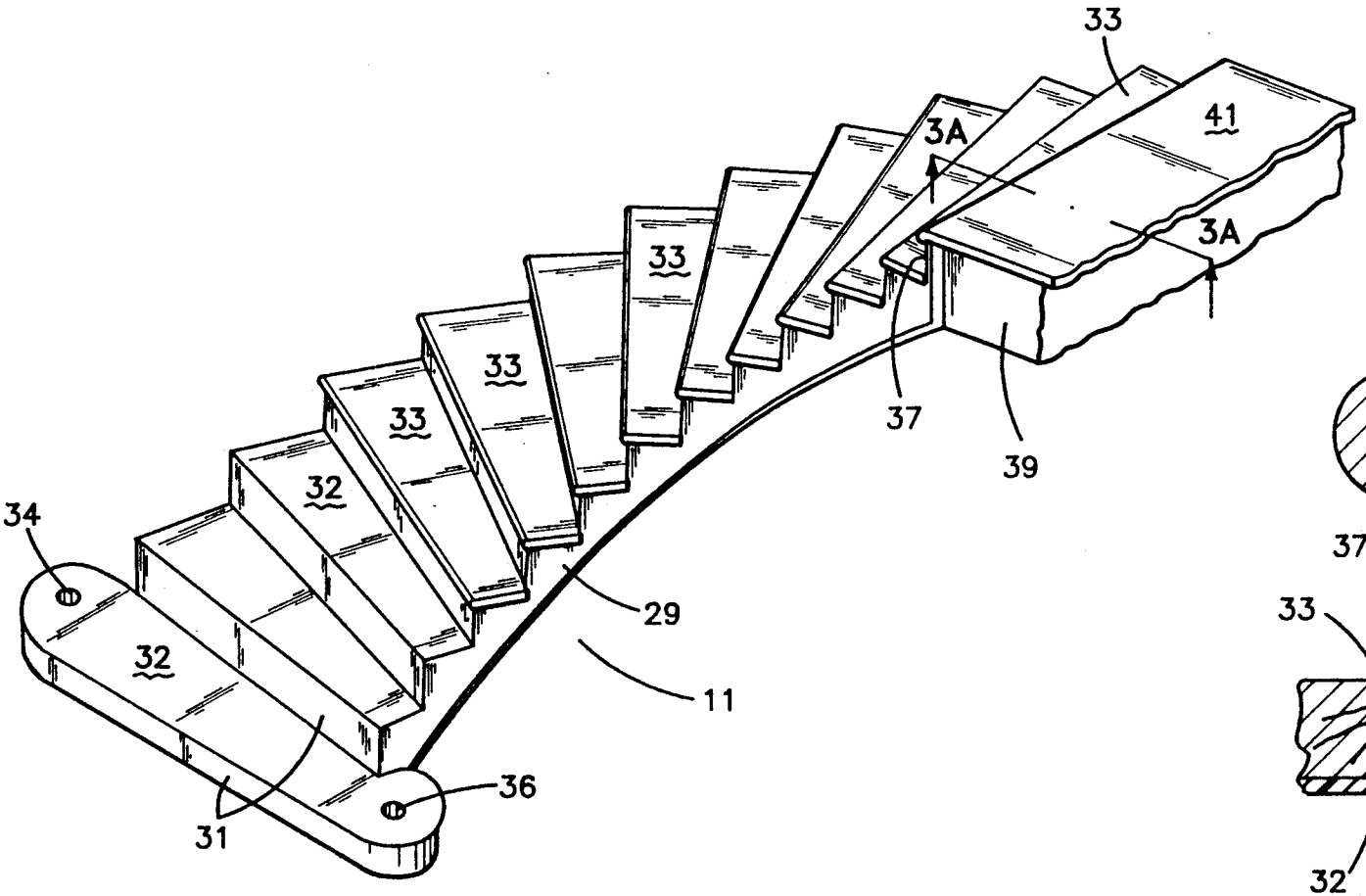
FIG. 3 is a perspective view of a free-standing preform.

In contrast, FIGS. 2 and 3 show curved stairway preforms 10 and 11 fabricated of plastic, fiberglass reinforced plastic, light metals such as aluminum or magnesium or composites of plastic, fiberglass and metals.

For purposes of claiming the invention it is intended that the language "preform" or "plastic preform" shall include the above fabrication materials.

For convenience in explaining the invention the preform material is selected to be fiberglass reinforced plastic.

Preform 10 (FIG. 2) includes curved stringers 12 and 13 connected in seamless fashion to risers 14 and first tread means 16. Risers 14 and first tread means 16 are, in turn, connected to one another in seamless fashion so as to create a composite, unitary, seamless curved stairway preform.

The stringer 12 is formed with an outer flange 17 offset outwardly from stringer 12 to create an upper shoulder 18. The flange 17 and shoulder 18 are also connected to stringer 12 in seamless fashion so as to be included in the unitary preform.

As is apparent in FIG. 2 flange 17 provides a means for securing the preform 10 to fixed members such as 2×4 studs 19.

In addition, if it is desired to enclose the left side of the preform 10, wall board or other panelling 21 is set upon the upper surface 15, the flange 17, and secured to the studs 19 while the shoulder 18 supports an additional panel 22.

The right stringer 13 is also formed with a flange 22 and a lower shoulder 23 offset inwardly in reverse fashion relative to the outer flange 17.

When it is intended to enclose the lower side of the preform panels 24 and 26 in contact with the inner flange 22 and lower shoulder 23, respectively, are secured to internal studs (not shown) and terminate at base molding 27 and floor 28.

As will be more apparent hereinafter, stringer 12 is formed with a plurality of slots or recesses 20 operable to receive an end portion of a wooden second tread means.

In some embodiments of the invention the recess 20 ends along the junction of the riser 14 and the first tread means 16 as shown in FIG. 2. In this arrangement a rear margin of the second tread means is received in the recess 20.

FIG. 3 shows a free standing, i.e. no panelling upper left or lower right, preform 11 having curved stringers 29 (only one shown) connected in seamless fashion to risers 31 and first tread means 32. Wooden second tread means 33 are shown overlaying some first tread means to indicate how the preform is trimmed out or finished. The lower most first tread means of the preform 11 is formed with openings 34 and 36 to facilitate securing newel posts as will be explained hereinafter.

As is most apparent in FIG. 3A, the top of the preform 11 whose upper riser 37, secured by suitable fasteners to fixed members 38 and 39, is shown in engagement with a landing 41.

Obviously the preform 11 of FIGS. 3 and 3A is trimmed out with balusters, newel posts and handrails on both sides in addition to the second tread means 33.

Figure 4:
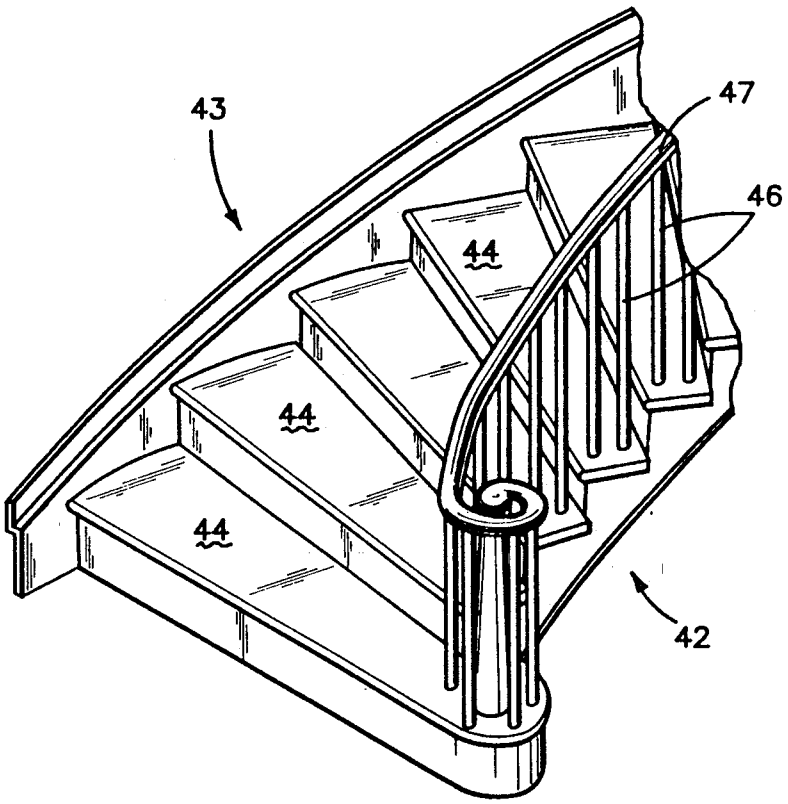
FIG. 4 is a perspective view of the bottom portion of a preform with second tread means, bottom newel post, handrail and balusters in place.

FIG. 4 shows a portion of a preform 42 designed with a flanged stringer 43 on the left for enclosing the left side in the manner shown in FIG. 2.

The right side of the preform 42, open below the preform, is trimmed out with wooden second tread means 44, balusters 46 and handrail 47.

Figure 4B:
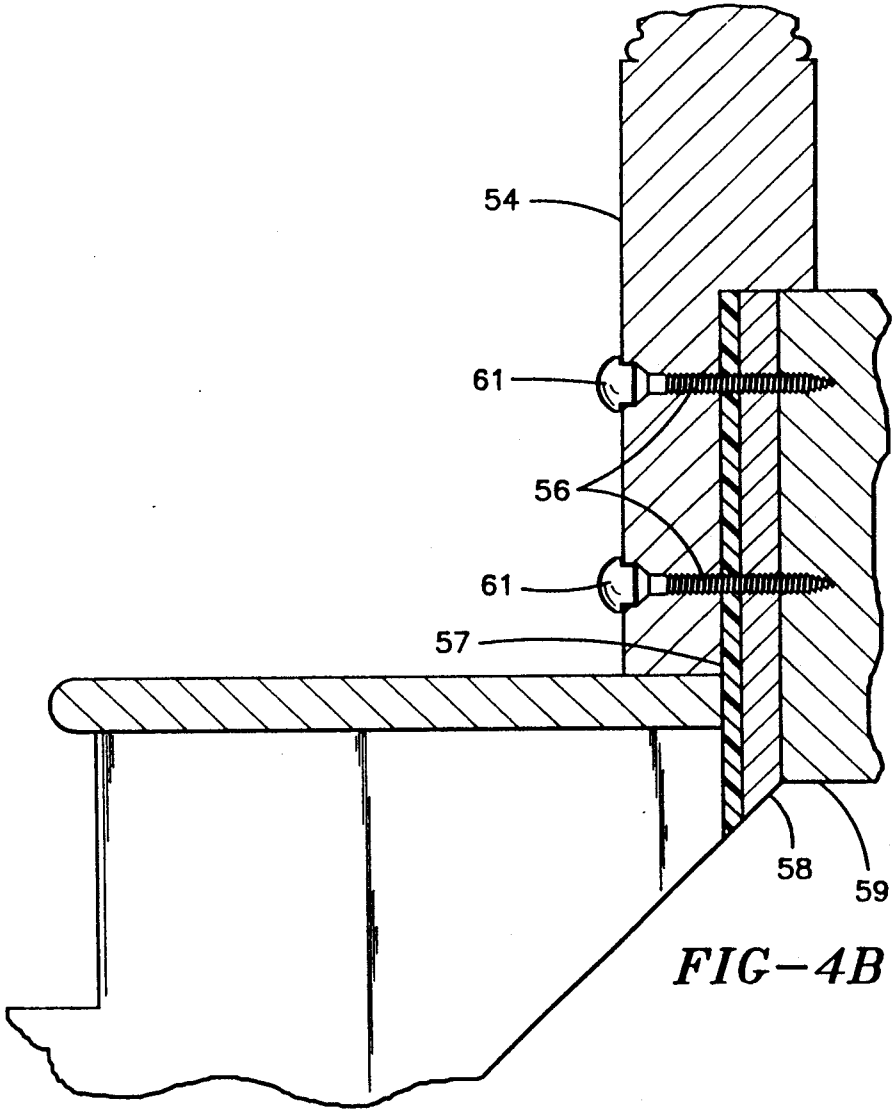
FIGS. 4A and 4B are vertical sections showing means for securing the bottom and top newel posts to the preform.
Figure 4A:
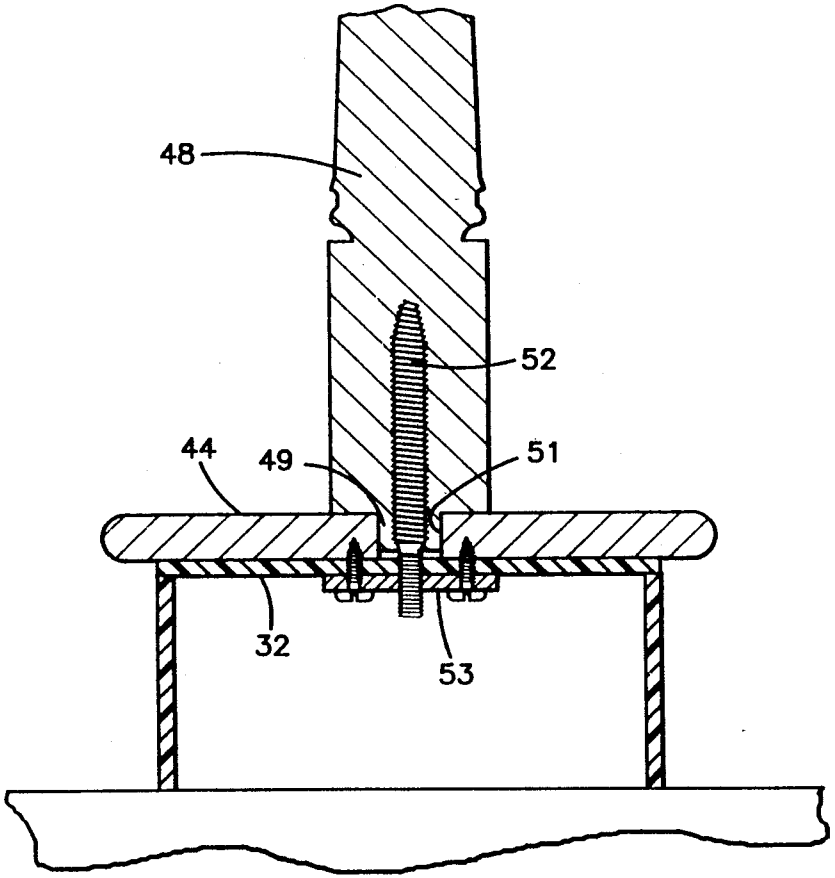

FIGS. 4A and 4B shows the method and manner of securing bottom newel post 48 to first and second tread means 32 and 44 respectively.

The bottom newel post 48 formed with a turning 49, is received in a mating bore 51 so that the post 48 bottoms on the second tread means 44 as shown.

A double ended fastener 52 having wood screw threads on one end and machine screw threads on the opposite end engages newel post 48 and a metal plate 53 secured to the first and second tread means as shown.

The top newel post 54 is fastened by wood screws 56 which intercept top preform riser 57 and the fixed support member joists 58, 59 to which the top of the preform 42 is secured.

To dress up the top newel post 54 wooden plugs 61 are inserted to hide the heads of the wood screws 56.

Figure 5:
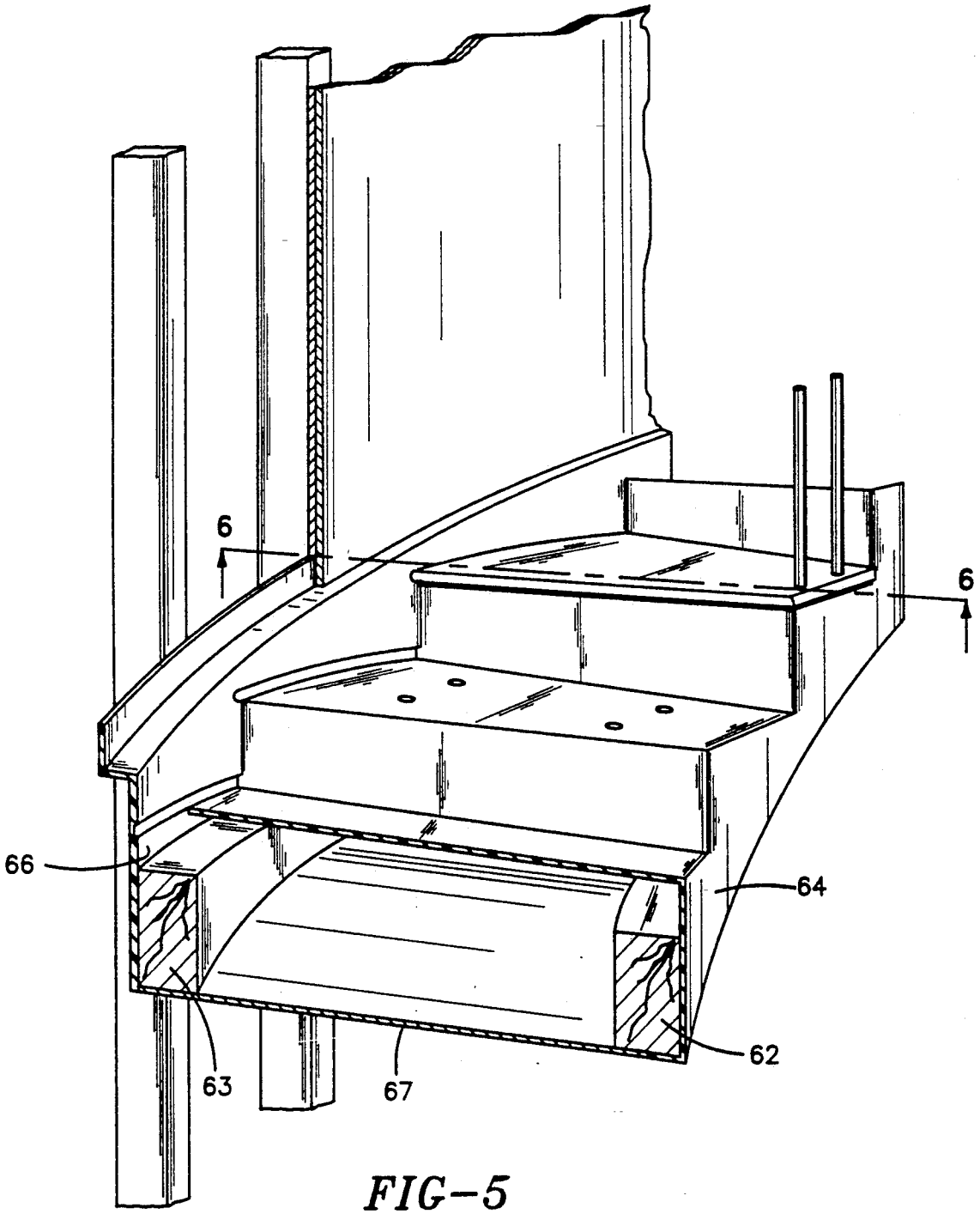
FIG. 5 is a perspective view of the portion of a preform wherein the left side and the under side of the preform are panelled.

FIG. 5 shows a preform similar to the illustration of FIG. 4 modified to provide structure for enclosing the underside of the stairway in that frame members 62 and 63 secured suitably to stringers 64 and 66, respectively, and extending along the interior of said stringers provide a support for securing a panel 67 spanning the underside of the preform. That is, the right side of the showing of FIG. 5 is open and the underside is enclosed by an appropriate panel or plaster board as desired.

Obviously the preform can be of opposite hand (right hand or left hand) including straight parallel stringers. In addition, as desired, the right side of the preform may be enclosed with the left side open. Balusters, handrail and second tread means are also incorporated.

Figure 6:
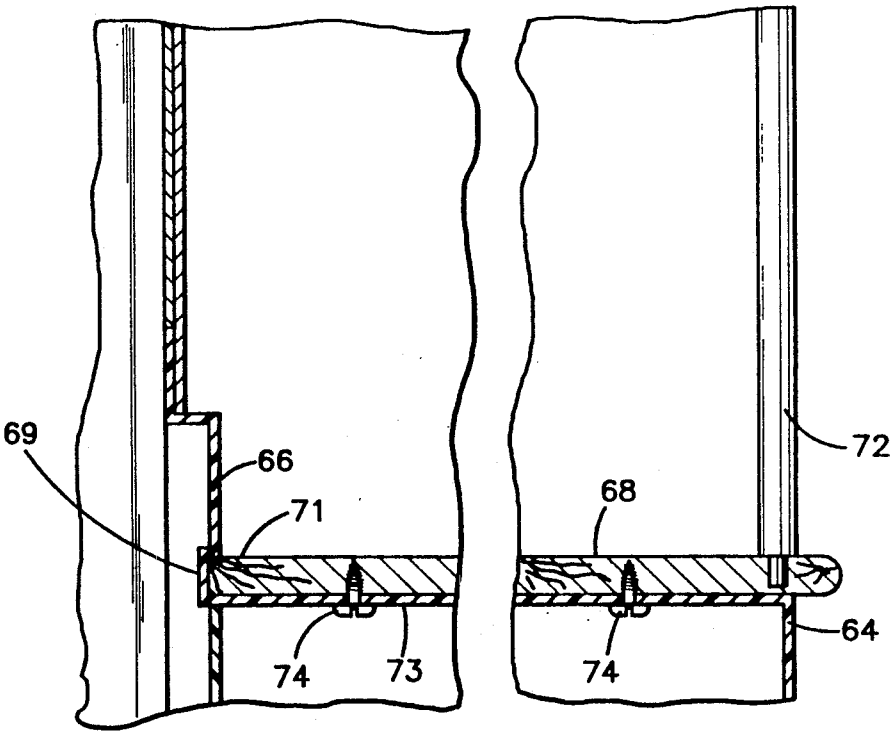
FIG. 6 is a vertical section of FIG. 5 in the plane of the line 6—6 showing the means for securing the second tread means to the first tread means.

FIG. 6 is a sectional view of FIG. 5 showing the installation of the second tread means 68 in a typical relationship between a stringer and a baluster wherein one end 71 of the second head means 68 is received in a slot or recess 69 formed in stringer 66 and the opposite end serves as a support for a baluster 72. Although the manner of securing the first tread means 73 to the second tread means 68 is optional, FIG. 6 shows wood screws 74 inserted from the underside of the first tread means 73.

Figure 7:
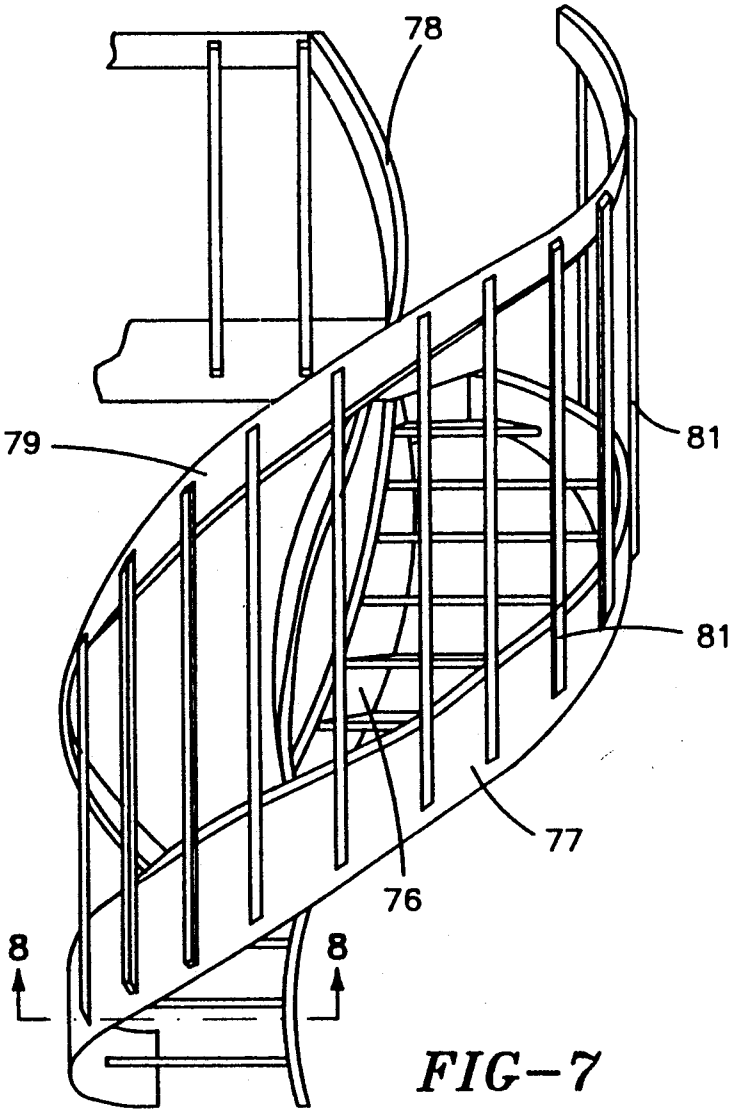
FIG. 7 is a perspective view of an alternative, curved stairway wherein the preform comprises curved parallel stringers and handrails connected by balusters and single tread means.

FIG. 7 shows an alternative curved stairway preform comprising individual (separate) curved stringers 76 and 77 and individual curved handrails 78 and 79. The handrails are secured to mating stringers by spaced balusters 81 secured by suitable fastening means at opposed ends thereof. Tread means 80 span the stringers 76, 77 and are recessed and secured as shown.

Figure 8:
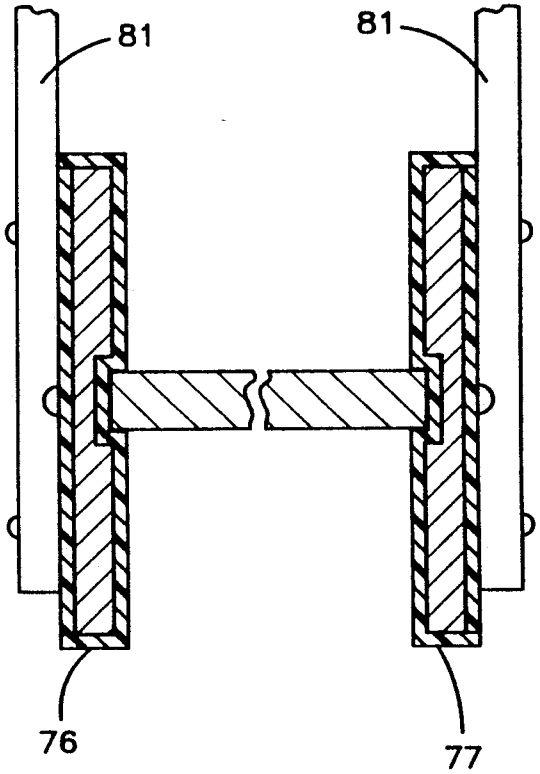
FIG. 8 is a vertical section showing the manner of securing tread means to the curved stringers; and, FIG. 9 shows the steps in assembling balusters to the handrail and to the second tread means.

FIG. 8 shows a sectional view of the illustration of FIG. 7 wherein stringers 76 and 77 are formed with indents 82 and 83 to receive a tread means 84 secured by fasteners 86.

Figure 9:
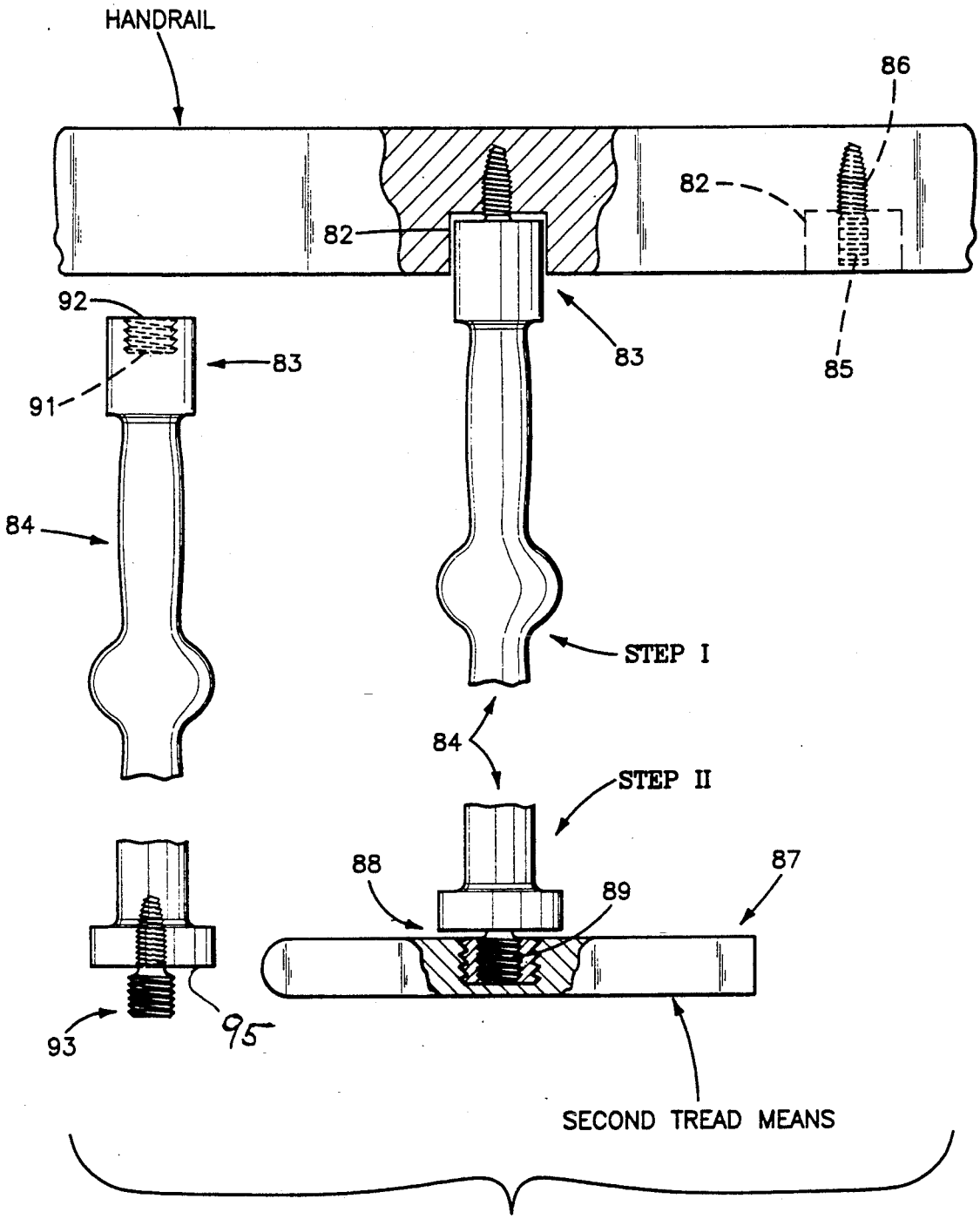

FIG. 9 shows the novel method of securing the balusters to the handrail and the second tread means.

Assume that a handrail has been assembled to the upper and lower newel posts by suitable fasteners and the balusters remain to be installed.

Assume further that the handrail at the point of connection with a baluster has been formed with a bore 82 adapted to receive the upper end 83 of a baluster 84 and with a second smaller bore 86 to receive a wood screw-machine screw.

A combined wood screw-machine screw 85 is inserted into the underside of the handrail so that the wood screw portion engages the smaller bore 86 with the machine screw portion exposed as shown.

The mating second tread means 87 is formed with a bore 89 fitted with a metal insert 88 having external wood screw threads and internal machine screw threads.

The baluster 84 is formed with a bore 91 at its upper end 83 to receive an insert 92 similar to insert 88.

The opposite end of baluster 84 is bored to receive a combined wood screw-machine screw 93 similar to the combined screw 85.

As shown in the sketch labelled step 1 in FIG. 9, the upper end of the baluster 84 is threadedly engaged with the machine screw portion of the combined screw 85. The upper portion 83 of the baluster 84 is bottomed in the bore 82.

Step 2 follows in that the exposed machine screw portion at the bottom of the baluster 84 is then threadedly engaged with the insert 88 in the second tread means 87.

Thereafter the baluster 84 is "backed out" of the bore 82 until the shoulder 95 abuts the second tread means 87.

The depth of the bore 82 is sufficient and the projection of the baluster into the bore is equally sufficient so that a portion of the baluster remains within the bore 82 when the baluster and the second tread means are abutted.

Obviously the trim of the several preforms of the present invention can be applied in a variety of levels of refinement including a variety of fastening means.

For example, one can add molding under the nosing of the second tread means. In addition, one could add a more fanciful handrail termination and newel post assembly such as shown in the prior art of FIG. 1.

It is to be understood that the essence of the invention resides in the low cost stairway preform having curved or straight stringers and appropriate first tread means with or without riser means having immediate utility on the construction site; but, calculated and designed to be combined with trim to create a faithful simulation of the classic, expensive all wooden staircase.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A unitary, seamless one piece curved stairway comprising:

a pair of spaced, curved, generally parallel stringer means extending vertically;

at least two tread means spaced vertically along and extending between the stringer means and formed integrally therewith whereby the at least two tread means follow the curve of the stringer means to define vertical steps; and at least one riser means extending between the at least two tread means and the stringer means and formed integrally with the tread means and the stringer means wherein the stringer means, the tread means and the riser means form a unitary, seamless one piece curved stairway.

2. A stairway according to claim 1 wherein the stairway is fabricated of fiberglass reinforced plastic.

3. A stairway according to claim 1 wherein at least one of said pair of stringer means includes flange means for securing the stairway to a rigid member.

4. A stairway according to claim 3 wherein the flange means is offset from the at least one of said pair of stringer means to define a first shoulder means operable to support panel means.

5. A stairway according to claim 1 wherein at least one of said stringer means includes a recess for receiving an end portion of a second tread means.

6. A stairway according to claim 5 wherein the second tread means is fabricated of wood and overlays said first tread means, a portion of said second tread means being received in said recess.

7. A stairway according to claim 6 including fastening means for securing said first and second tread means together securely.

8. A stairway according to claim 1 wherein a second tread means fabricated of wood overlays each said at least two tread means.

9. A stairway according to claim 8 wherein said second tread means projects over a riser.

10. A stairway according to claim 8 wherein said second tread means projects over at least one of said pair of stringer means.

11. A stairway according to claim 8 wherein at least one of said pair of said first stringer means includes a recess for receiving end portions of said second tread means.

* * * * *